US007547012B2

(12) United States Patent
Izuchi

(10) Patent No.: US 7,547,012 B2
(45) Date of Patent: Jun. 16, 2009

(54) SHEET FEEDER IMAGE FORMING DEVICE

(75) Inventor: Masatoshi Izuchi, Ichinomiya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 133 days.

(21) Appl. No.: 11/715,002

(22) Filed: Mar. 7, 2007

(65) Prior Publication Data

US 2007/0210507 A1 Sep. 13, 2007

(30) Foreign Application Priority Data

Mar. 7, 2006 (JP) ..... 2006-061058

(51) Int. Cl.
*B65H 3/52* (2006.01)

(52) U.S. Cl. ..... 271/121

(58) Field of Classification Search ..... 271/121, 271/122, 125, 167, 104, 137
See application file for complete search history.

(56) References Cited

U.S. PATENT DOCUMENTS 5,527,026 A 6/1996 Padget et al.
7,216,864 B2 * 5/2007 Yoshihara ..... 271/145
2005/0001371 A1 1/2005 Otsuki

FOREIGN PATENT DOCUMENTS

| | | | |
|---|---|---|---|
| JP | 1-110442 | * | 4/1989 |
| JP | 8-259013 | | 10/1996 |
| JP | 10-59572 | | 3/1998 |
| JP | 2002-87624 | * | 3/2002 |
| JP | 2003-81468 | | 3/2003 |
| JP | 2004-338905 | | 12/2004 |

* cited by examiner

*Primary Examiner*—Patrick H Mackey
*Assistant Examiner*—Thomas A Morrison
(74) *Attorney, Agent, or Firm*—Reed Smith LLP

(57) ABSTRACT

A sheet feeder including (1) a sheet storing unit in which a plurality of sheets are stacked, (2) a sheet feed roller that abuts an uppermost one of the sheets stacked in the sheet storing unit and conveys the sheets in a predetermined conveying direction, (3) a friction member provided in the bottom plate, that abuts a lowermost one of the sheets stacked in the sheet storing unit, and (4) a rotation suppressing member that suppresses rotation of the friction member. Wherein the friction member is a roller member including a roller portion, and a plurality of fibrous members arranged at an outer peripheral surface of the roller portion. Wherein the bottom plate of the sheet storing unit has an opening that houses the friction member. Wherein the sheet feed roller abuts the friction member when there is no sheet in the sheet storing unit.

16 Claims, 15 Drawing Sheets

SHEET FEEDER IMAGE FORMING DEVICE

The present invention is based on Japanese Patent Application No. 2006-061058 filed Mar. 7, 2006, the contents of which are incorporated by reference.

BACKGROUND OF THE INVENTION

1. Field of the Invention

The present invention relates to a sheet feeder that separates and conveys stacked sheets (such as recording sheets or OHP films) one by one by the rotation of a sheet feed roller. These stacked sheets may be used in image forming devices, such as copying machines, printers, and facsimiles. More specifically, the invention relates to a sheet feeder capable of suppressing an excessive torque applied to a sheet feed roller, thus preventing damages to the sheet feed roller or a driving unit for the sheet feed roller. Such an excessive torque is generated when there is no stacked sheet present in the sheet feeder. As used herein, a roller or a feeder that conveys objects other than sheets of paper are called a sheet feed roller or a sheet feeder respectively.

2. Discussion of Related Art

A sheet feeder used for image forming devices, such as copying machines, printers, and facsimiles, that is configured such that stacked sheets are separated and conveyed one by one is known in the related art. This type of sheet feeder is equipped with (1) a placing plate on which sheets are stacked, (2) a sheet feed roller that is arranged so as to face the placing plate, and (3) a friction member that is disposed in a position on the placing plate facing the sheet feed roller.

According to this sheet feeder, a biasing force of a biasing means places the sheet feed roller in pressure contact with a stack of sheets on the placing plate. As the sheet feed roller rotates in a predetermined direction, only the uppermost sheet of the sheets stacked on the placing plate is separated from the remaining sheets and conveyed in a predetermined conveying direction. At this time, since a frictional force generated between the roller surface of the sheet feed roller and the uppermost sheet is greater than a frictional force generated between the uppermost sheet and a sheet underneath the uppermost sheet, sheets are separated one by one, and conveyed in a predetermined conveying direction.

Further, the lowermost sheet abuts the friction member, and thus the lowermost sheet is suppressed in its movement by a frictional force generated between the friction member and the lowermost sheet. For this reason, even when a few sheets are left on the placing plate, the so-called double feeding, where the lowermost sheet is conveyed together with the sheet above the lowermost sheet, is prevented. As a result, the stacked sheets are separated one by one and conveyed in a predetermined conveying direction. Also, when there is no sheet on the placing plate, the biasing force of the biasing means brings the sheet feed roller into contact with the friction member.

Meanwhile, when the sheet feed roller is caused to rotate in the state where the sheet feed roller is in contact with the friction member, an excessive frictional force is generated between the friction member and the surface of the sheet feed roller. Therefore, an excessive torque is applied to the sheet feed roller. Accordingly, unpleasant noises may be generated, or the sheet feeder itself may malfunction.

Thus, in order to avoid applying an excessive torque to the sheet feed roller, JP-A-8-259013 discloses a sheet feeder configured such that a freely rotatable roller that is connected to a spring is provided in a portion of a bottom plate that faces a sheet feed roller, and when there is no sheet on a placing plate, the roller surface of the sheet feed roller is caused to abut the peripheral surface of the freely rotatable roller so that an undesired frictional force cannot be generated.

However, in such a configuration, double feeding may occur when there are only a few sheets on the placing plate (e.g., two sheets, three sheets, etc.). When there is a great enough number of sheets (e.g., several tens of sheets) on the placing plate, such that the weight of the sheets is sufficient, the freely rotatable roller is suppressed in its rotation by the weight of the sheets and the biasing force of the spring. Therefore, when there is a sufficient number of sheets on the placing plate, the uppermost sheet can be separated and conveyed individually. However, when there are only a few sheets on the placing plate, the force against the rotation of the freely rotatable roller becomes too weak to suppress the rotation of the freely rotatable roller, resulting in double feeding.

In addition, the frictional force between the sheet feed roller and the uppermost sheet may be reduced due to adhesion of foreign substances, such as paper debris, to the surface of the sheet feed roller. Accordingly, the supply of recording sheets may become unstable.

The present invention has been made in consideration of the above problems. It is therefore an object of the invention to provide a sheet feeder and an image forming device that are (1) capable of preventing an excessive load from being applied to a sheet feed roller when there is no sheet on the placing surface, (2) capable of preventing double feeding of sheets, and (3) capable of restoring frictional force on the surface of the sheet feed roller.

SUMMARY OF THE INVENTION

A sheet feeder including (1) a sheet storing unit having a bottom plate on which a plurality of sheets are stacked, (2) a sheet feed roller that is configured to abut an uppermost one of the sheets stacked on the bottom plate and convey the sheets in a predetermined conveying direction, (3) a friction member that is provided in a position of the bottom plate that faces the sheet feed roller, and is configured to abut a lowermost one of the sheets stacked in the sheet storing unit, and (4) a rotation suppressing member configured to suppress rotation of the friction member. Wherein the friction member is a roller member including a roller portion, and a plurality of fibrous members arranged at an outer peripheral surface of the roller portion. Wherein the bottom plate of the sheet storing unit is provided with an opening that houses the friction member. Wherein the sheet feed roller abuts the friction member when there is no sheet in the sheet storing unit.

An image forming device including a printer unit that forms a desired image on a sheet, and a sheet feeder. The sheet feeder including (1) a sheet storing unit having a bottom plate on which a plurality of sheets are stacked, (2) a sheet feed roller that is configured to abut an uppermost one of the sheets stacked on the bottom plate and convey the sheets in a predetermined conveying direction, (3) a friction member that is provided in a position of the bottom plate that faces the sheet feed roller, and is configured to abut a lowermost one of the sheets stacked in the sheet storing unit, and (4) a rotation suppressing member configured to suppress rotation of the friction member. Wherein the friction member is a roller member including a roller portion, and a plurality of fibrous members arranged at an outer peripheral surface of the roller portion. Wherein the bottom plate of the sheet storing unit is provided with an opening that houses the friction member. Wherein the sheet feed roller abuts the friction member when there is no sheet in the sheet storing unit.

A sheet feeder including (1) a sheet storing unit in which a plurality of sheets are stacked, (2) a sheet feed roller configured to abut an uppermost one of the sheets stacked in the sheet storing unit, (3) a friction member configured to abut a lowermost one of the sheets stacked in the sheet storing unit, and (4) a rotation suppressing member configured to suppress rotation of the friction member. Wherein the sheet feed roller abuts the friction member when there is no sheet in the sheet storing unit.

DETAILED DESCRIPTION OF EMBODIMENTS

Figure 1:
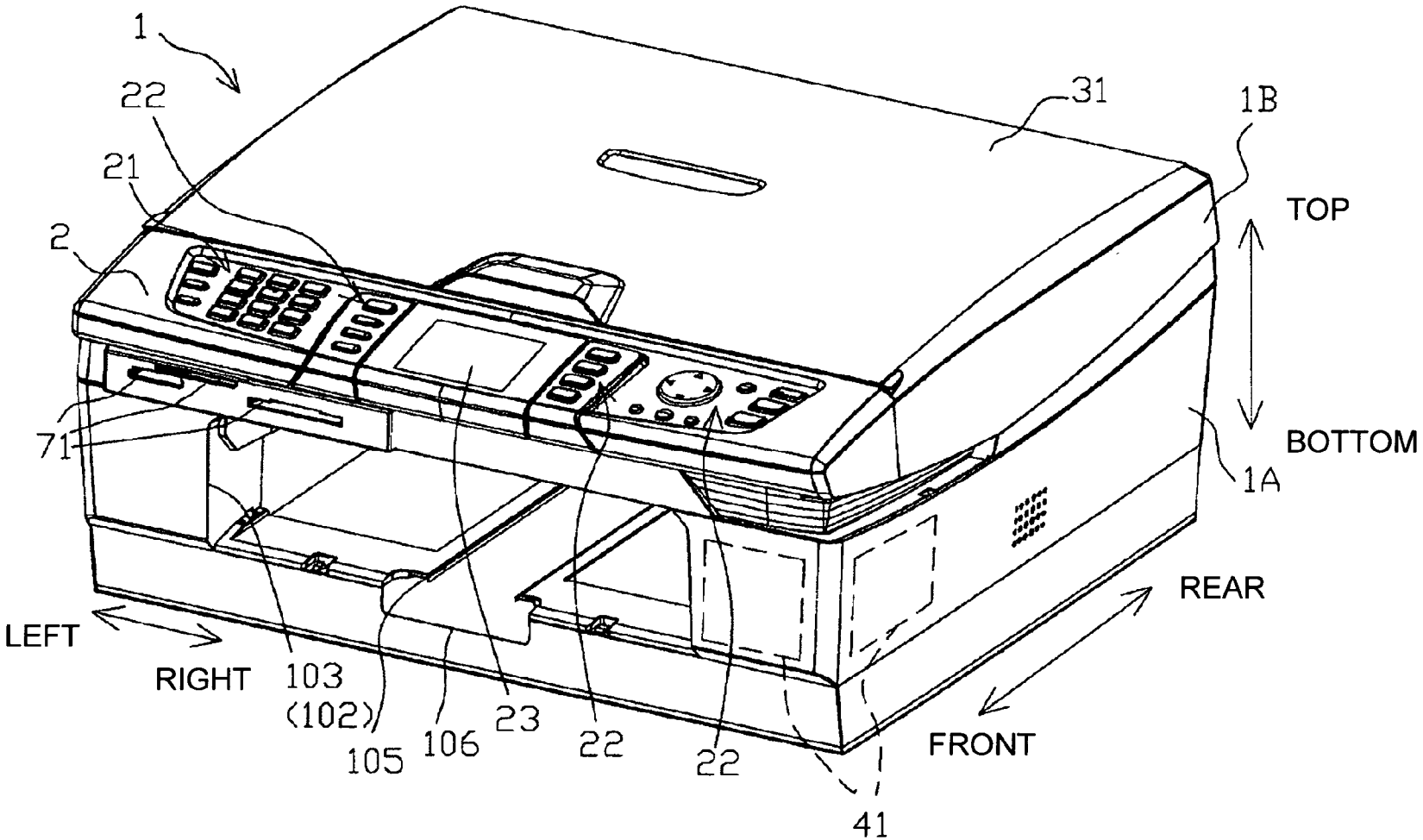
FIG. 1 is a perspective view of a multi-function device to which the invention is applied.

Referring now to the drawings, the present invention will be described in detail on the basis of the preferred embodiments.

Figure 2:
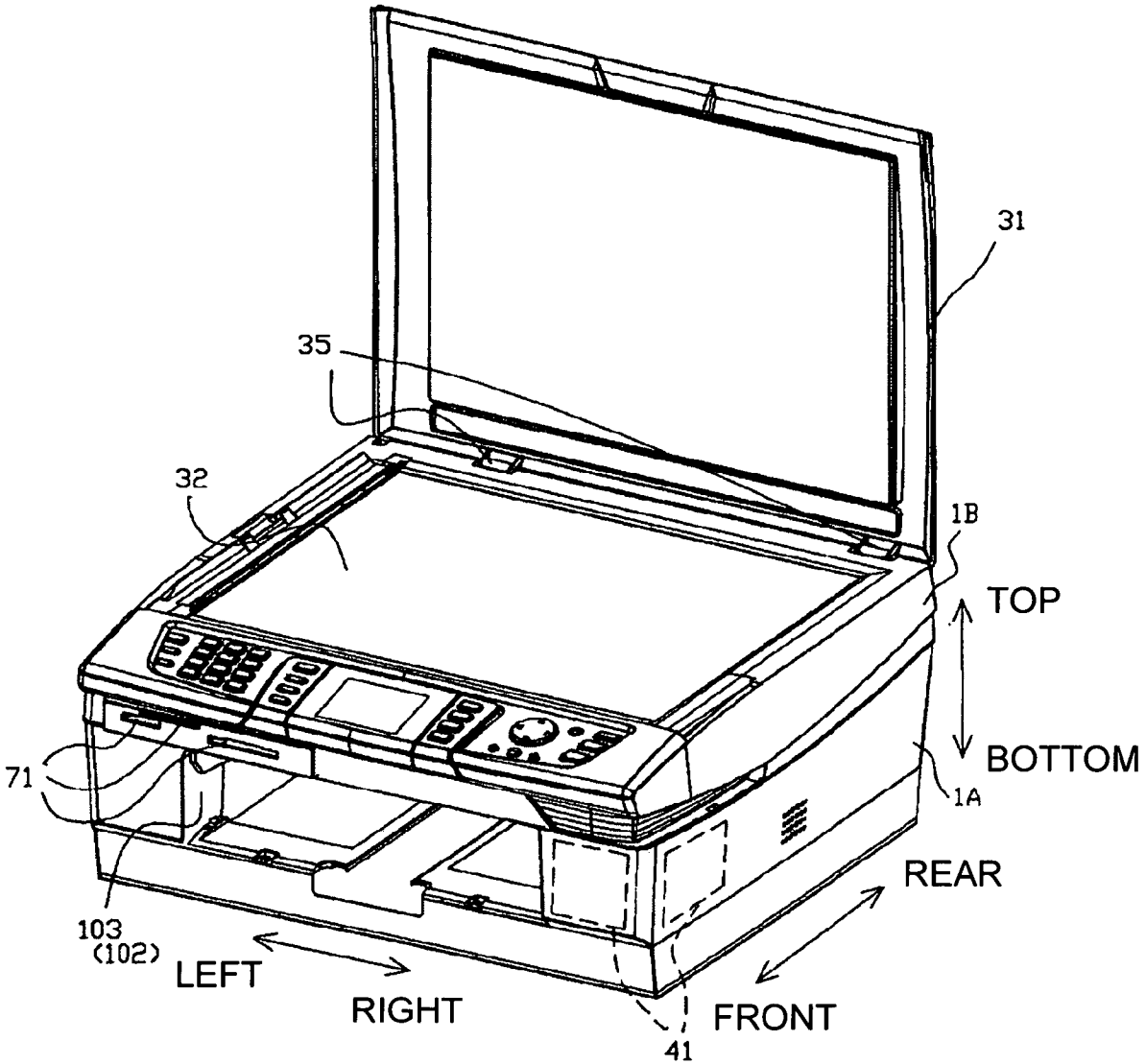
FIG. 2 is a perspective view of the multi-function device of FIG. 1 when a document cover of an image reading device of the multi-function device is opened.

An image forming device shown in FIGS. 1 and 2 is a multi-function device (hereinafter referred to as "MFD") 1 equipped with multiple functions (e.g., a printer function, a copying function, a scanner function, a facsimile function, etc.).

The MFD 1 is roughly composed of a main device 1A, and an image reading device 1B that is rotatably arranged at the top of the main device 1A. Further, an operation panel 2 is disposed at the front top of the MFD 1. The operation panel 2 is provided with various keys, such as numeric keypads 21 and function keys 22. When a user pushes down these keys, various operations are performed. A liquid crystal display 23 (hereinafter referred to as "LCD") is provided at the center of the operation panel 2. The LCD 23 is capable of displaying setting states or various operation messages of the image forming device.

The image reading device 1B is a device for reading an image on a document during copying, facsimile transmission, and/or scanning. The image reading device 1B includes (1) a document-placing glass plate 32 that allows a document to be placed thereon, (2) a document cover 31 capable of covering the top face of the image reading device, and (3) a contact image sensor (hereinafter referred to as "CIS", not shown) that is disposed underneath the glass plate 32 to read a document. The CIS is configured so that it can reciprocate along a guide shaft (not shown) that extends in the right-and-left direction of the MFD 1 in FIG. 1 or 2. Further, a rear end of the document cover 31 is mounted to a rear end of the image reading device 1B so that it can rotate vertically about hinges 35 (refer to FIG. 2).

A control board (not shown) for controlling a printer unit 4 (refer to FIG. 3) and/or various functions is disposed inside the main device 1A. Further, the front of the main device 1A is provided with a plurality of slots 71 that allow a plurality of kinds of card-type recording media (e.g., memory cards) to be inserted therethrough. Examples of recording media include memory sticks®, smart media®, compact flashes®, SD memory cards®, and XD picture cards®.

An ink storage portion 41 with its top open is disposed inside the main device 1A (front right side in FIGS. 1 and 2). The ink storage portion 41 is exposed when the image reading device 1B is rotated upward from the top of the main device 1A by a rotating mechanism (not shown). Color ink cartridges for black (BK), cyan (C), magenta (M), and yellow (Y) inks can be housed in the ink storage portion 41. The ink cartridges, and an inkjet printhead 42 in the printer unit 4 as will be described below are always connected with each other via flexible ink supply tubes (not shown), respectively.

Figure 3:
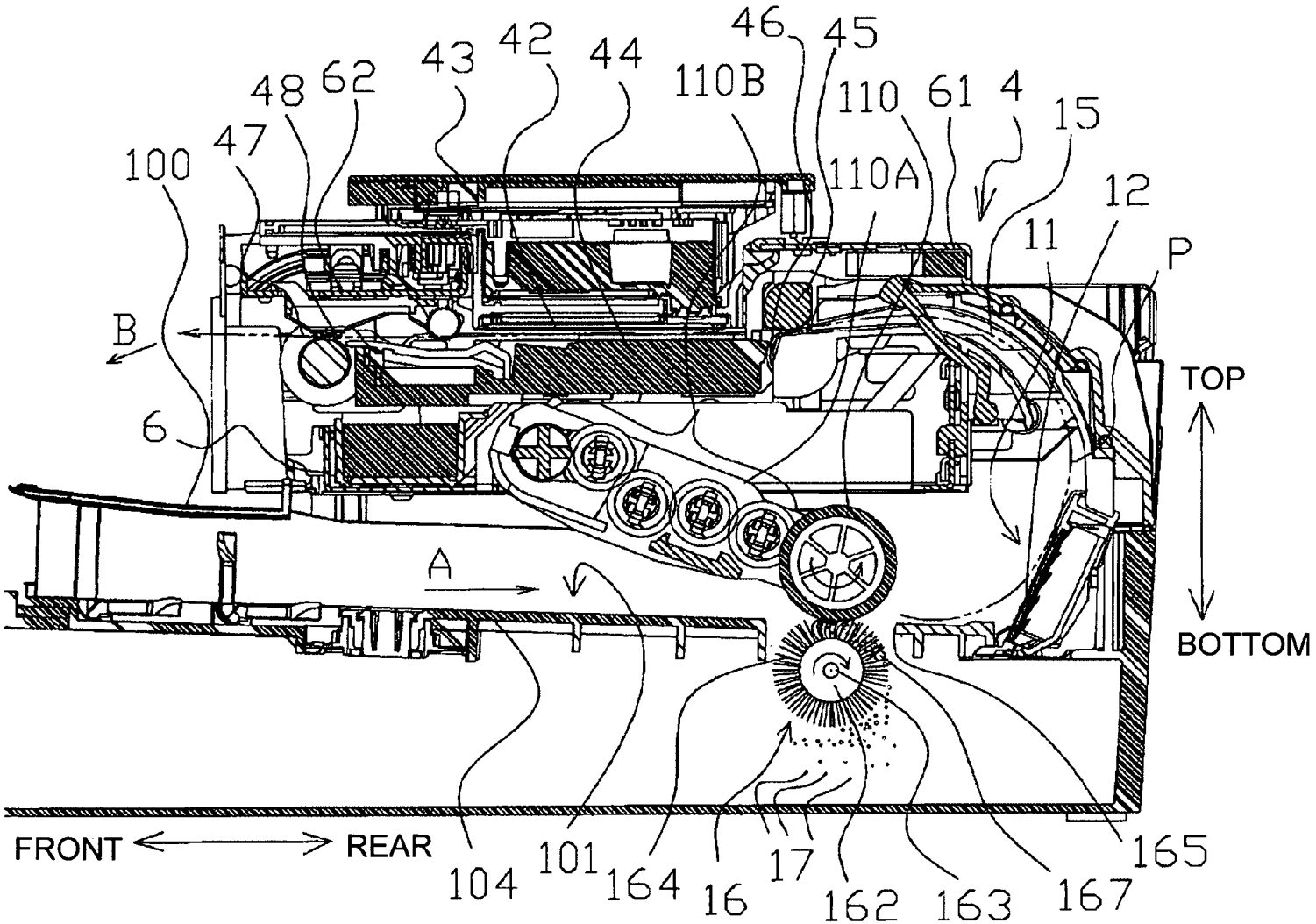
FIG. 3 is an enlarged side sectional view showing a printer unit and a sheet feed unit of the multi-function device of FIG. 1.
Figure 4:
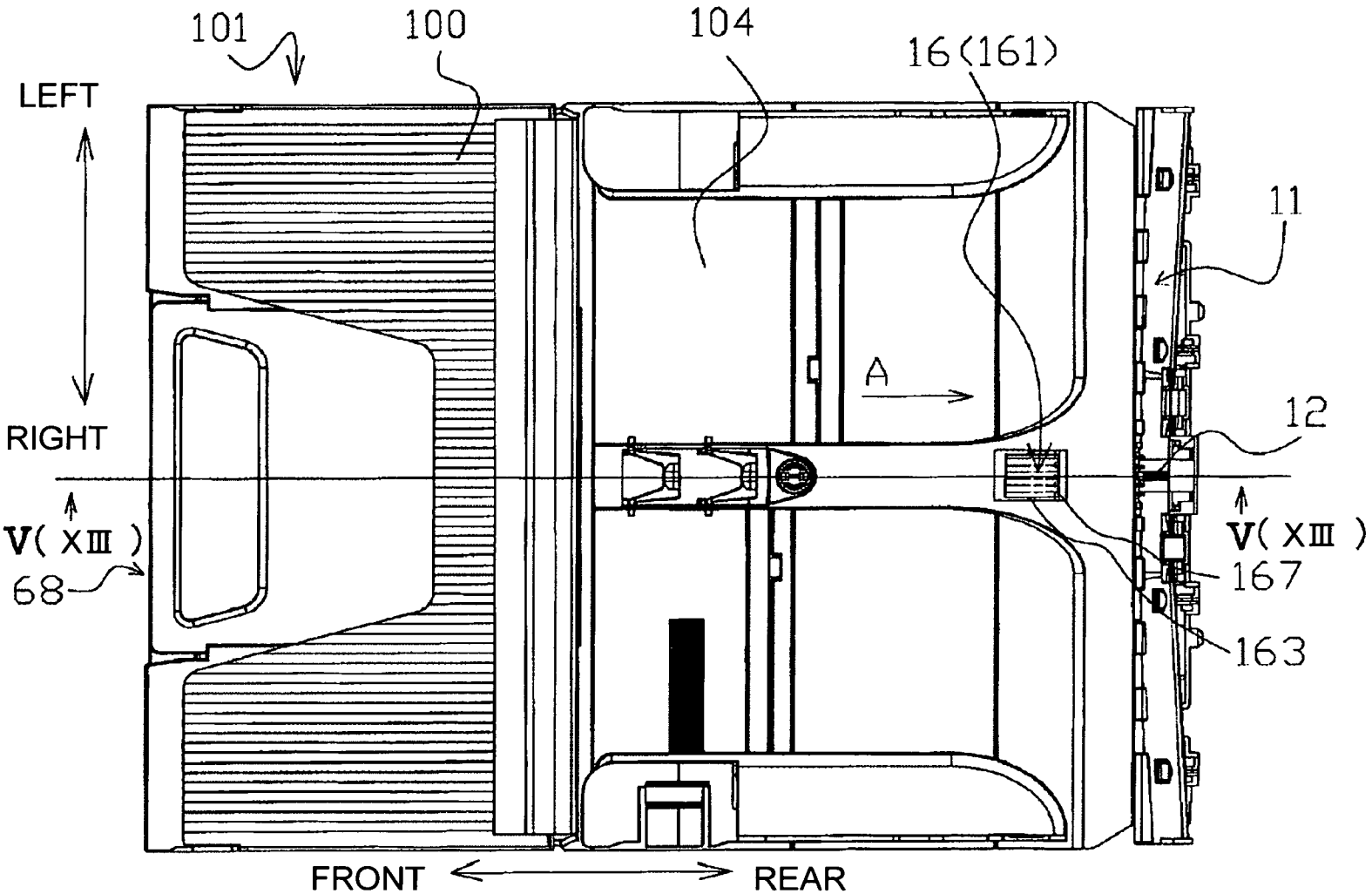
FIG. 4 is a top plan view of a sheet feed tray according to a first embodiment.
Figure 5:
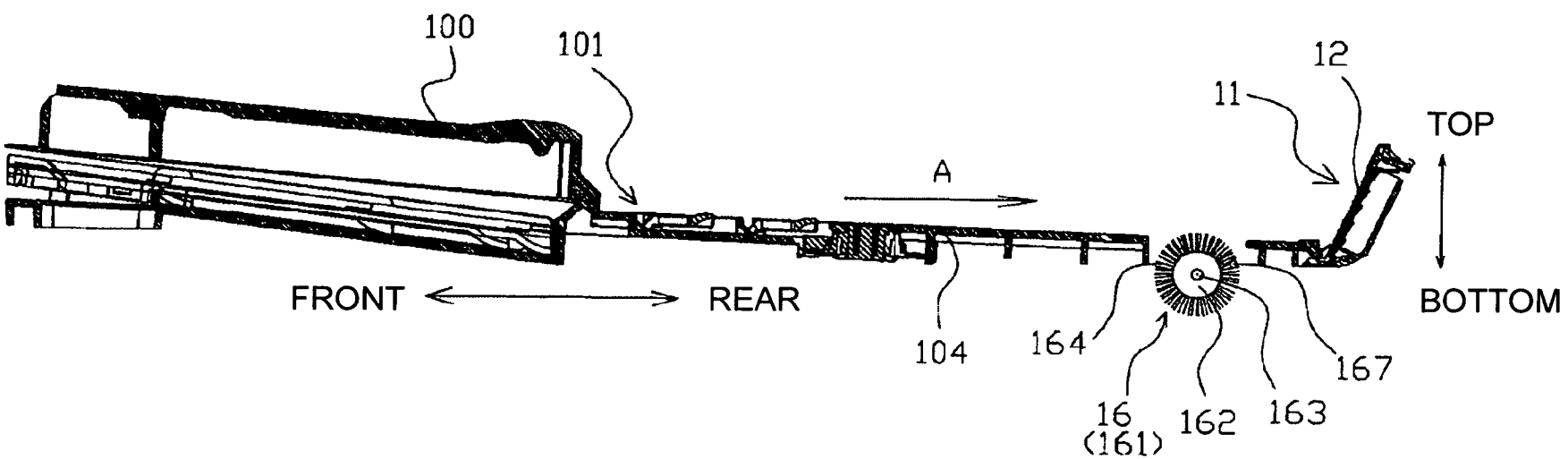
FIG. 5 is a side sectional view taken along the line V-V in FIG. 4.

A sheet feed tray 101, in which sheets P are stacked, is movably disposed at the bottom of the main device 1A (refer to FIGS. 3 to 5). In the present embodiment, the sheet feed tray 101 can accommodate a plurality of sheets of various sizes (e.g., A4 size, letter size, legal size, postcard size, resin sheets that are used for an overhead projector, etc.). The sheet feed tray 101 can be inserted into, and pulled out through, an opening 103 at the front (refer to FIGS. 1 and 2) of the main device 1A. Hereinafter, the configuration of the sheet feed tray 101 will be described in detail with reference to FIGS. 4 and 5.

The sheet feed tray 101 is provided with a friction member 16 as will be described below (refer to FIGS. 3 to 9). The friction member 16 protrudes below the sheet feed tray 101 (see FIG. 5). As shown in FIG. 1, the bottom of the opening 103 is provided with a housing groove 105. When the sheet feed tray 101 is inserted into the main device 1A through the opening 103, the friction member 16 is guided into the main device 1A along the housing groove 105. Therefore, when inserted, the sheet feed tray 101 will not be hindered due to the inner bottom face of the main device 1A. Further, an access portion 106 is provided integrally with the housing groove 105, at the front of the housing groove 105. It is easy for a user to detach the sheet feed tray 101 from the main device 1A by inserting his finger into the access portion 106 and gripping a handle 68 (see FIG. 4) of the sheet feed tray 101.

As shown in FIG. 3, a sheet feed roller 110 is provided above the sheet feed tray 101. The sheet feed roller 110 is supported by a distal end of a sheet feed arm 110A so that it can be brought close to, or separated from, the sheet feed tray 101 (i.e., moved up and down, rotated, etc.).

A gear transmission mechanism 110B is provided in the sheet feed arm 110A. The sheet feed roller 110 is connected to a power source (not shown) via the gear transmission mechanism 110B. The gear transmission mechanism 110B is configured such that a plurality of gears mesh with each other. By starting the above power source, the driving force from the power source is transmitted to the sheet feed roller 110, so as to rotate the sheet feed roller 110.

A proximal end of the sheet feed arm 110A is supported by a supporting portion (not shown) provided in a metal main frame 6, enabling the sheet feed arm 110A to rotate around the supporting portion (not shown). This enables the sheet feed arm 110A to pivot in the up-and-down direction with the supporting portion (not shown) as the pivot center. The sheet feed arm 110A is biased toward the sheet feed tray 101 by a biasing member, such as a clutch or a spring (not shown), when the sheet feed tray 101 is mounted. When the sheet feed tray 101 is inserted into, or pulled out of, the main device 1A, a retracting means (not shown) retracts the sheet feed arm 110A upward from the sheet feed tray 101. The sheet feed roller 110 is brought into pressure contact with the surface of the sheets P stacked on the sheet feed tray 101 when the sheet feed roller 110 is rotated below by the biasing member.

An inclined separation plate 11 is disposed on the deep side (rear side in FIGS. 4 and 5) of the sheet feed tray 101. The inclined separation plate 11 protrudes towards the sheets P in the middle of their width direction (right-and-left direction in FIG. 4). Further, the inclined separation plate 11 is formed in a convexly curved shape in plan view such that it retreats as it goes toward the right and left ends of the sheet P in its width direction. Moreover, an elastic separation pad 12 is provided at the center of the inclined separation plate 11 in the width direction of the sheets P. The elastic separation pad 12 abuts leading edges of the sheets P. The sheets P stacked on the sheet feed tray 101 are separated one from the others by (1) the inclined separation plate 11, (2) the friction member 16 and sheet feed roller 110, and (3) conveyed to a conveying path 15.

Once a sheet P is separated from the others, it is advanced along a sheet feed direction (direction indicated by an arrow A) and is conveyed to the printer unit 4 via the conveying path 15. The conveying path 15 includes a substantially rolling U-shaped path as shown in FIG. 3.

Referring to FIG. 3, the printer unit 4 is provided on the downstream side of the sheet feed direction (direction indicated by the arrow A), after the conveying path 15 has made a U-turn upward from the bottom of the main device 1A. The printer unit 4 is provided with a carriage 43, a carriage motor (not shown), a driving roller 45, a nip roller 46, a sheet discharge roller 47, and a spur roller 48. These elements are supported by a box-like main frame 6 with its top open, a pair of right and left side plates (not shown), a first guide member 61, and a second guide member 62.

A platen 44 is a flat member that extends in the right-and-left direction (direction orthogonal to the sheet discharge direction). The platen 44 is provided in a position that faces the undersurface of the printhead 42, and is fixed to the main frame 6 between the first guide member 61 and the second guide member 62.

Pulleys (not shown) are attached to both ends of the second guide member 62. The carriage motor (not shown) is linked to one of these pulleys on the left (depth direction in FIG. 3), and is fixed to the undersurface of the second guide member 62. Further, an endless belt (not shown) is wound around the pulleys, and the carriage 43 is connected to the endless belt. Therefore, when the carriage motor is driven, the driving force of the carriage motor is transmitted to the carriage 43 via the endless belt. Thus, the carriage 43 is reciprocated in the right-and-left direction (direction orthogonal to the sheet discharge direction) along the first guide member 61 and the second guide member 62. The position and reciprocation of the printhead 42 is monitored by an encoder (not shown) for the carriage. An inkjet printhead 42 is mounted on the carriage 43.

On the upstream side of the printhead 42 in the sheet feed direction, the driving roller 45 and the nip roller 46 are provided. The driving roller 45 is rotationally driven by an LF motor (not shown). The driving roller 45 and the nip roller 46 nip a sheet P that is conveyed along the conveying path 15. As the driving roller 45 is rotated, the sheet P is fed to the downstream side of the conveying path 15, and is then disposed on platen 44. The sheet discharge roller 47 and the spur roller 48 are provided on the downstream side of the printhead 42. The sheet discharge roller 47 is rotationally driven by the LF motor (not shown) that drives the driving roller 45. That is, the sheet discharge roller 47 is adapted to be driven in synchronization with the driving roller 45 via an interlocking mechanism (not shown). The sheet discharge roller 47 and the spur roller 48 nip the sheet P onto which ink droplets have been ejected. As the sheet discharge roller 47 is rotationally driven, the sheet P is fed to the downstream side in the sheet feed direction.

The nip roller 46 is elastically biased against the driving roller 45 so as to press the driving roller 45 with a predetermined pressing force. Accordingly, when the sheet P has entered the space between the driving roller 45 and the nip roller 46, the nip roller 46 nips the sheet P in cooperation with the driving roller 45 while the nip roller 46 elastically retreats by the thickness of the sheet P. Since the sheet P is nipped by the driving roller 45 and the nip roller 46 in this way, the rotational force of the driving roller 45 is reliably transmitted to the sheet P. The spur roller 48 is also provided with respect to the sheet discharge roller 47 similarly to the manner in which the nip roller 45 is provided with respect to the driving roller 45. However, in the present embodiment, the roller surface of the spur roller 48 is formed in the shape of a spur so as not to deteriorate an image formed on the sheet P.

The sheet nipped by the driving roller 45 and the nip roller 46 is intermittently conveyed on the platen 44 by a predetermined linefeed width corresponding to a print width for one scanning. The printhead 42 is reciprocated every linefeed of the sheet P. First, the printhead 42 is driven to discharge ink liquid, and the discharged ink liquid is adhered to a predetermined position on the sheet P to form an image for one scanning. Next, the sheet P is conveyed as much as a predetermined amount corresponding to the print width for one scanning via the driving roller 45 and the nip roller 46. Thereafter, the carriage 43 is again reciprocated in the right-and-left direction whereby an image for the next one scanning is formed. The sheet P having the image formed thereon is nipped by the sheet discharge roller 47 and the spur roller 48 from its leading end. That is, the sheet P is intermittently conveyed with its leading end nipped by the sheet discharge roller 47 and the spur roller 48, and with its trailing end nipped by the driving roller 45 and the nip roller 46. While the sheet is conveyed in this way, an image is formed on the sheet P by the printhead 42.

When an image is formed in a predetermined region on the sheet P in this way, the sheet discharge roller 47 is rotationally driven continuously. After the sheet P is nipped by the sheet discharge roller 47 and the spur roller 48, the sheet P is discharged onto a sheet discharge tray 100, with its image formation surface upward.

The sheet discharge tray 100, as shown in FIGS. 3 to 5, is provided in an upper portion of the sheet feed tray 101. A sheet discharge port 102 that communicates with the sheet discharge tray 100 is opened in common with the front opening 103 of the main device 1A.

Figure 6:
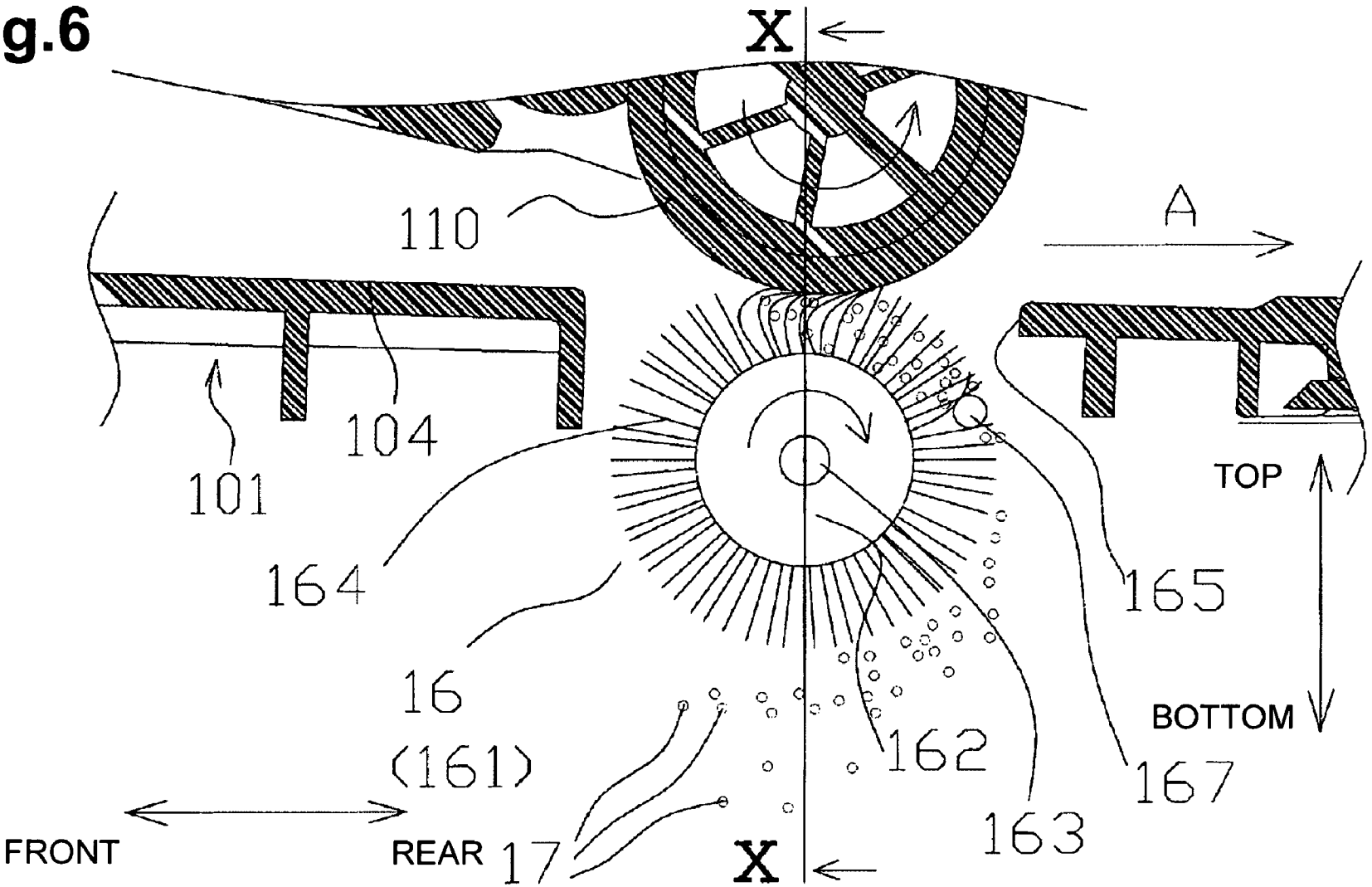
FIG. 6 is an enlarged side sectional view of principal parts of a sheet feeder according to the first embodiment.

As shown in FIG. 6, the friction member 16 is a rotatable roller member 161. The roller member 161 is housed in an opening 165 (hereinafter referred to as "hole") provided in a bottom plate (placing plate) 104 of the sheet feed tray 101. The hole 165 is provided in the position of the bottom plate 104 that faces the sheet feed roller 110 when the sheet feed tray 101 is mounted into the main device 1A.

The roller member 161 includes a roller portion 162 having a rotary shaft 163, and a number of fibrous members 164. The fibrous members 164 are arranged in the shape of a brush on the outer peripheral surface of the roller portion 162.

Figure 10:
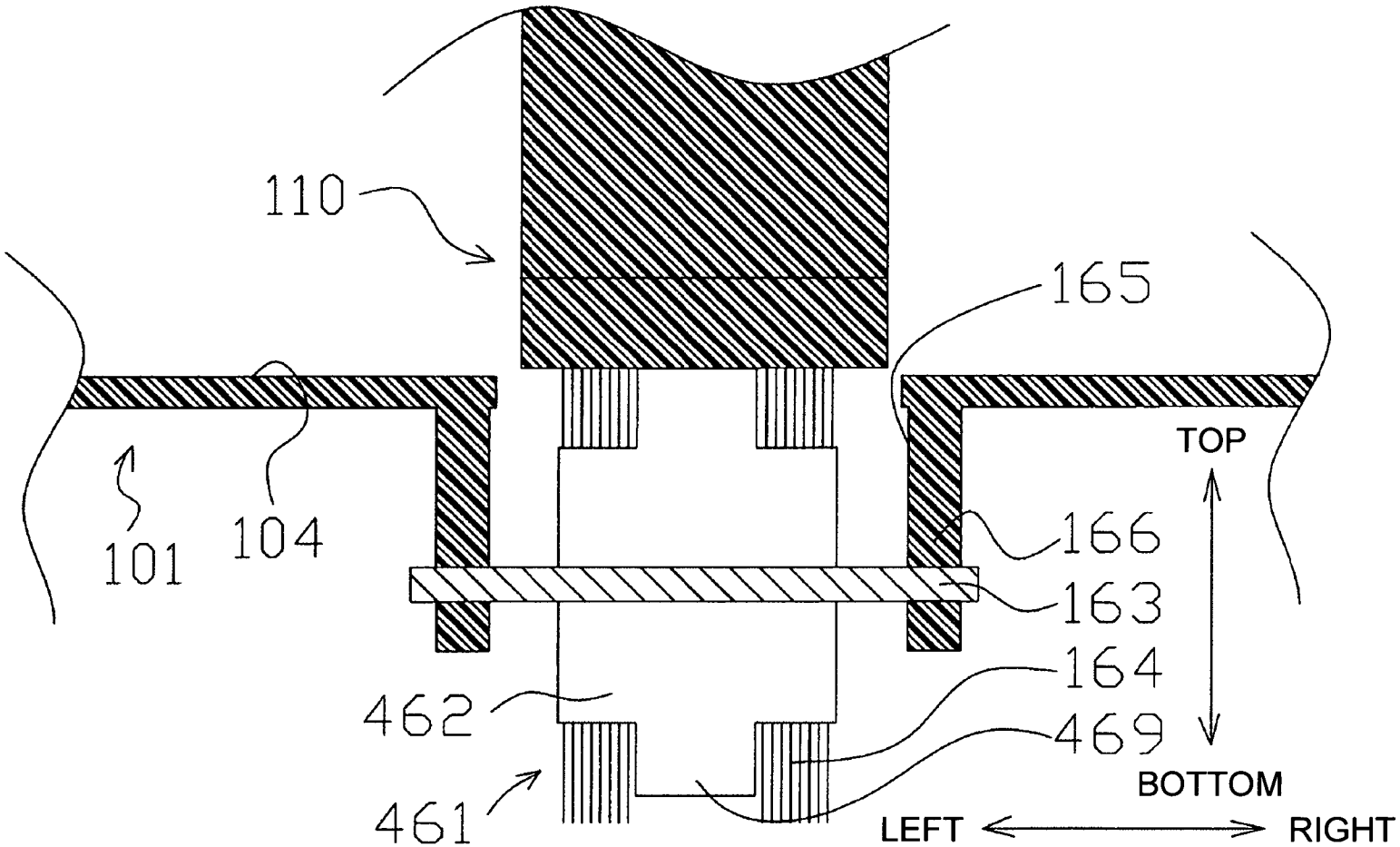
FIG. 10 is an enlarged side sectional view of principal parts of a sheet feeder according to a second embodiment (taken along the line X-X in FIG. 6).

The hole 165 is provided with a supporting portion 166 (refer to FIG. 10) for supporting the rotary shaft 163 of the roller member 161. Although FIG. 10 is a view showing a second embodiment, the configuration of the supporting portion 166 is similar to that of the first embodiment. The supporting portion 166 is composed of two side walls protruding from the rear face of the bottom plate 104 and openings provided in the side walls. The rotary shaft 163 of the roller member 161 is supported by the supporting portion 166 at right angles to the conveying direction of the sheet P. Further, a portion of the roller member 161 supported by the supporting portion 166 is provided to be exposed to the surface of the bottom plate 104 via the hole 165. Here, the surface of the bottom plate 104 is the surface on which sheets P are stacked.

The hole 165 is provided with a rotation suppressing member 167 that suppresses the rotation of the roller member 161. Similarly to the rotary shaft 163, the rotation suppressing member 167, which is a wire-like linear member, is supported by the supporting portion 166 at right angles to the sheet conveying direction. A drawing showing the way of attaching the rotation suppressing member 167 to the supporting portion 166 has been omitted. However, the rotation suppressing member 167 is attached to the supporting portion 166 in substantially the same manner as the rotary shaft 163A is attached to the supporting portion 166. The rotation suppressing member 167 is disposed in a position where it abuts the fibrous members 164 of the roller member 161.

Figure 7:
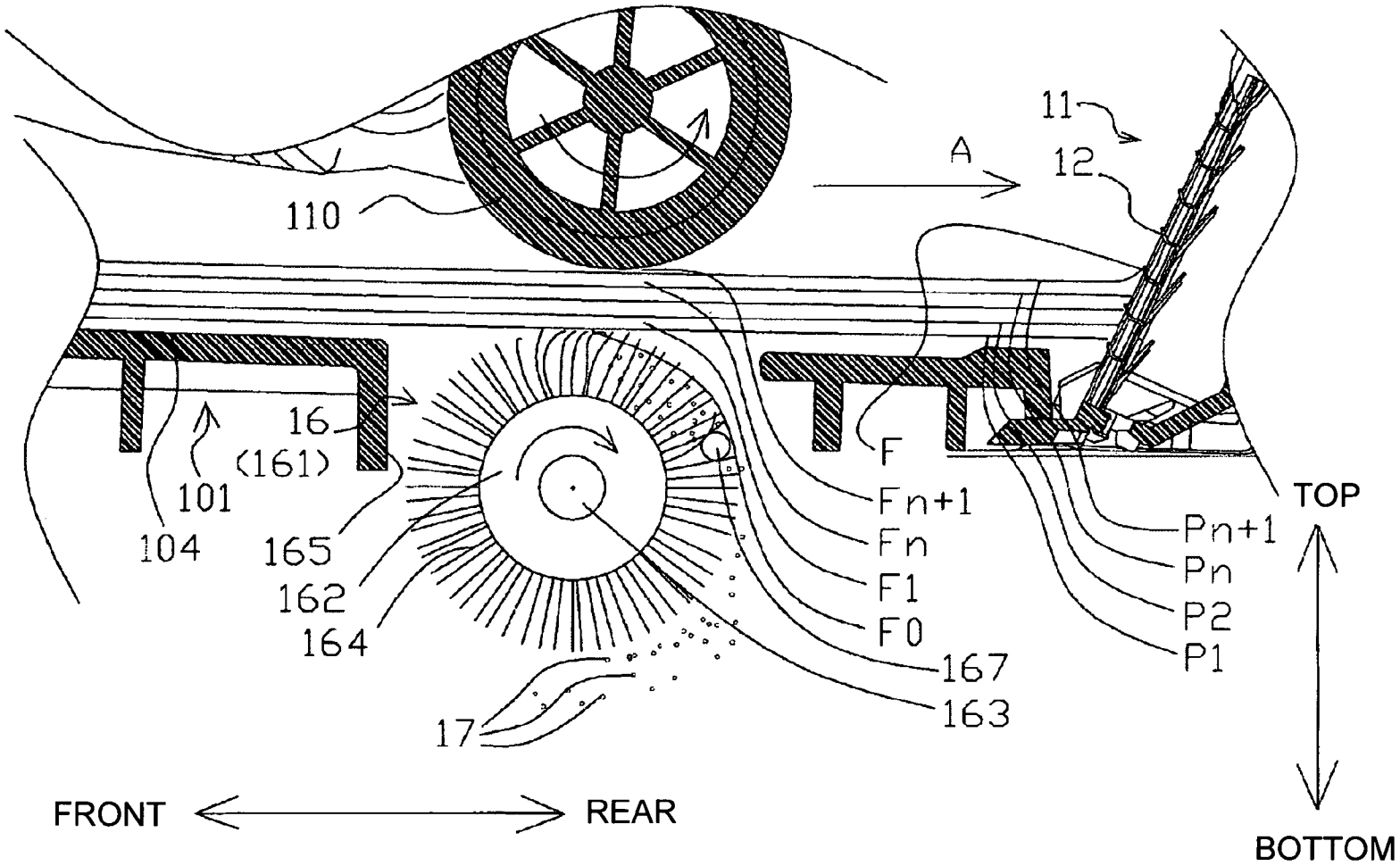
FIG. 7 is a schematic view illustrating the operation of the sheet feeder according the first embodiment.

When a number of, for example, several tens of sheets P are stacked in the sheet feed tray 101, as shown in FIG. 7, a lowermost sheet P1 of the stacked sheets P is caused to abut the roller member 161. Further, an uppermost sheet Pn+1 of the stacked sheets P is in touch with a sheet Pn right below the uppermost sheet Pn+1 and the elastic separation pad 12.

When the sheet feed roller 110 abuts the uppermost sheet Pn+1, and rotates in the conveying direction, a first frictional force Fn+1 is generated between the sheet feed roller 110 and the uppermost sheet Pn+1. Further, a second frictional force Fn is generated between the uppermost sheet Pn+1 and the sheet Pn right below the uppermost sheet Pn+1.

Meanwhile, when the sheet feed roller 110 abuts the uppermost sheet Pn+1, and rorates in the conveying direction, the leading end of the sheet Pn+1 is pressed against the elastic separation pad 12 by the rotation of the sheet feed roller 110, thereby generating a resisting force F between the elastic separation pad 12 and the uppermost sheet Pn+1.

If the resisting force F is greater than the second frictional force Fn and is smaller than the first frictional force Fn+1, slip occurs between the uppermost sheet Pn+1 and the sheet Pn right below the uppermost sheet Pn+1.

Due to the above-described relations between the first and second frictional forces and the resisting force F, and the rotation of the sheet feed roller 110, the uppermost sheet Pn+1 is separated from the sheet Pn right below the uppermost sheet Pn+1, and then conveyed in a predetermined direction by the sheet feed roller 110.

In a case where the number of the sheets P accommodated and remaining in the sheet feed tray 101 is two, when the sheet feed roller 110 abuts an upper sheet P2 of the two sheets P, and then rotates in a predetermined direction, the first frictional force Fn+1 is generated between the sheet feed roller 110 and the upper sheet P2, and the resisting force F is generated between the leading end of the upper sheet P2 and the elastic separation pad 12. Further, a frictional force Fn is generated between the upper sheet P2 and the lowermost sheet P1, and a third frictional force F0 is generated between the lowermost sheet P1 and the roller member 161.

In that case, if the third frictional force F0 is smaller than the second frictional force Fn, so-called double feeding may occur where the sheet P2 and the sheet P1 are not separated from each other and conveyed together by the sheet feed roller 110.

In the present embodiment, the rotation of the roller member 161 is suppressed by the rotation suppressing member 167. For this reason, even when the sheet feed roller 110 abuts the sheet P2, and rotates in a predetermined direction, the roller member 161 is not rotated by the rotation of the sheet feed roller 110. Therefore, since the third frictional force F0 can be obtained sufficiently, double feeding can be prevented.

When the number of the sheets P accommodated in the sheet feed tray 101 is one, that is, when the lowermost sheet P1 is conveyed, the third frictional force F0 is generated between the lowermost sheet P1 and the roller member 161. Since the third frictional force F0 is smaller than the first frictional force Fn+1, the lowermost sheet P1 is conveyed by the sheet feed roller 110.

When there is no sheet P accommodated in the sheet feed tray 101, the sheet feed roller 110 abuts the roller member 161, and rotates in a predetermined direction. Although the roller member 161 is suppressed in its rotation by the rotation suppressing member 167, the roller member is rotatable while being in abutment on the sheet feed roller 110. Therefore, even when the sheet feed roller 110 rotates while being in abutment on the roller member 161, an excessive torque is not applied to the sheet feed roller 110. Accordingly, it is possible to prevent unpleasant noises or trouble with the sheet feeder itself, which may be caused when an excessive torque is applied to the sheet feed roller 110.

When the sheet feed roller 110 abuts the roller member 161, and rotates in a predetermined direction, the roller member 161 is suppressed in its rotation by the rotation suppressing member 167. Therefore, the roller member rotates while it resists the rotational force of the sheet feed roller 110. At this time, since the fibrous members 164 of the roller member 161 abut the surface of the sheet feed roller 110, foreign substances 17, such as paper debris adhering to the surface of the sheet feed roller 110 are removed by the fibrous members 164. Specifically, the fibrous members abut the rotation suppressing member 167, and the rotation of the roller member 161 is suppressed by the elastic force of the fibrous members 164. When the roller member 161 is rotated by the sheet feed roller 110, the fibrous members 164 are deflected, and when the roller member is rotated further, the fibrous members 164 are separated from the rotation suppressing member 167. At this time, an elastic force in the fibrous members 164 themselves is generated, causing the fibrous members 164 to return to their original shape. This force separates the foreign substances 17 from the roller member 161, so that it is possible to prevent the foreign substances 17 on the roller member 161 from adhering to the sheet feed roller 110. Since the rotation suppressing member 167 is provided on the downstream side of the rotary shaft 163 of the roller member 161, the foreign substances 17, such as paper debris, are separated from the roller member 161 in a downward direction by the rotation suppressing member 167. Further, since a downward force is applied to the foreign substances 17 so as to shake them off, the foreign substances 17 are kept away from the sheet feed roller 110 and the sheet P. Therefore, it is possible to prevent foreign substances from adhering again to the sheet feed roller 110. Moreover, since the frictional force on the surface of the sheet feed roller 110 is prevented from being reduced, the sheet P can be stably fed by the sheet feed roller 110.

Figure 8:
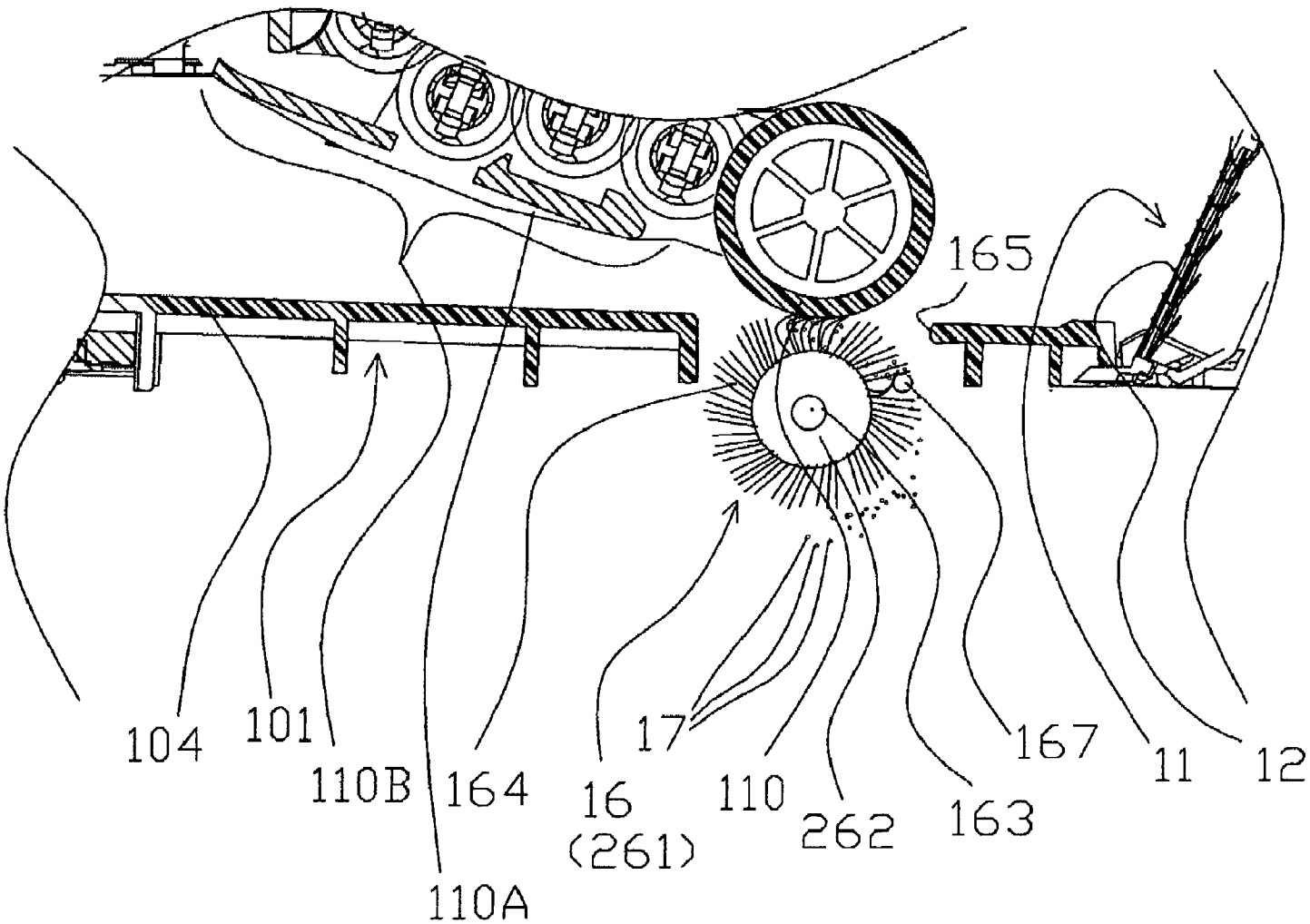
FIG. 8 is a sectional view of the sheet feeder according to a modification of the first embodiment.

Next, modifications of the first embodiment will be described in detail with reference to FIGS. 8 and 9. FIG. 8 shows Modification 1, and FIG. 9 shows Modification 2.

As Modification 1, FIG. 8 shows a configuration in which the fibrous members 164 are arranged at the outer peripheral surface of a roller portion 262 such that they make an acute angle with the outer peripheral surface of the roller portion 262 with respect to a predetermined rotation direction. When there is no sheet P on the sheet feed tray 101 and the sheet feed roller 110 rotates in a direction in which it carries the sheet P, as described above, the rotating sheet feed roller 110 abuts a roller member 261, and the roller member 261 is rotated in a predetermined direction. When the roller member 261 is rotated by the sheet feed roller 110, the fibrous members 164 are caused to abut a rotation suppressing member 267, deflecting the fibrous members 164 are deflected. At this time, since the fibrous members 164 are arranged such that they makes an acute angle with the outer peripheral surface of the roller portion 262 with respect to a predetermined rotation direction, the bending amount of the fibrous members 164 can be increased when the fibrous members 164 are bent by the rotation of the roller member 261.

Further, when the roller member is rotated further, the fibrous members 164 are separated from the rotation suppressing member 267. Since the bending amount of the fibrous members 164 is large, the impact when the fibrous members 164 are separated from the rotation suppressing member 267 is increased. This impact allows the foreign substances 17, which have been removed from the surface of the sheet feed roller 110 by the fibrous members 164, to be more reliably separated from the roller member 261. Since the foreign substances 17 are separated from the roller member 261, it is possible to prevent the foreign substances 17 from adhering again to the sheet feed roller 110 from the roller member 261.

Figure 9:
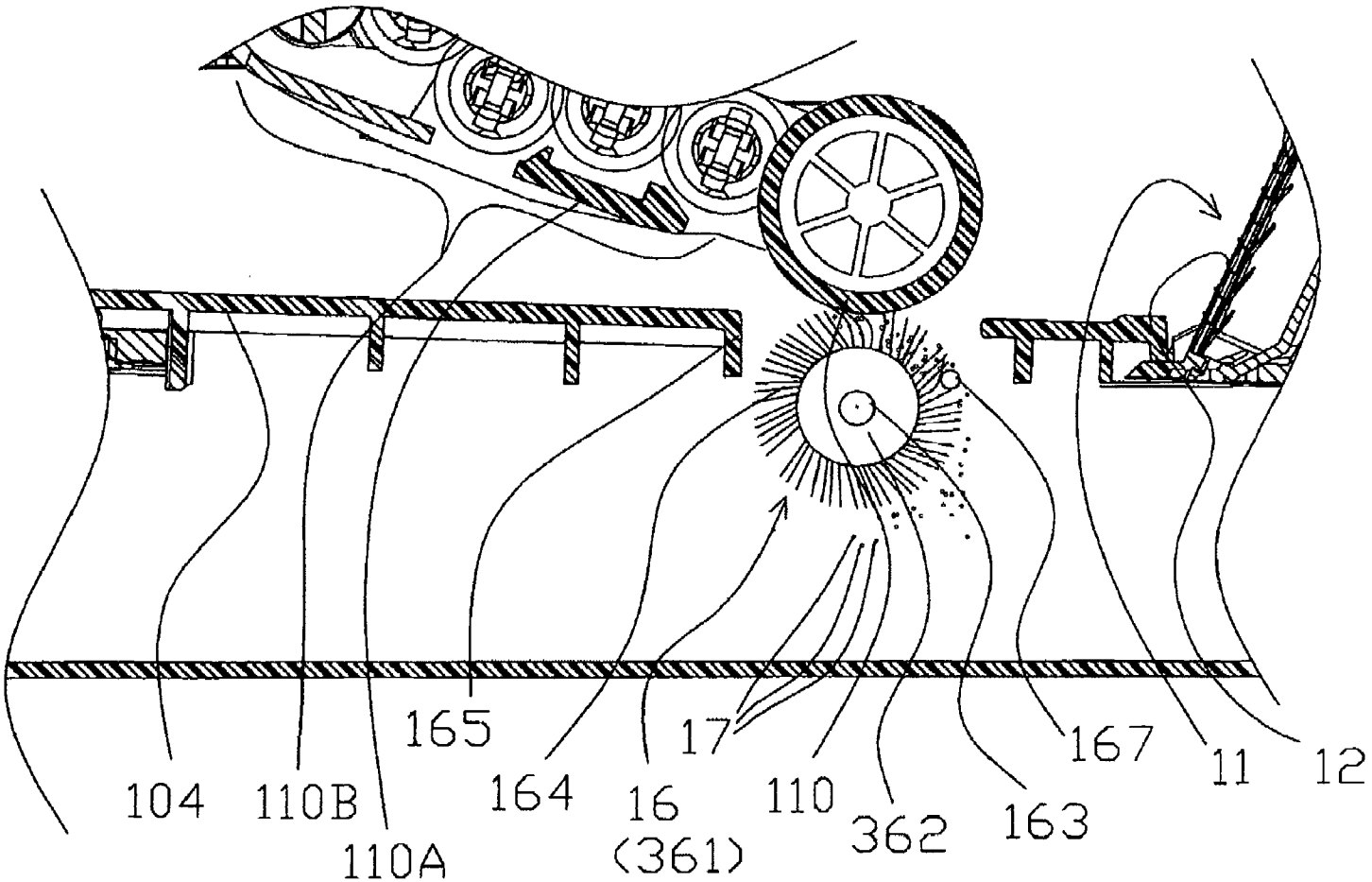
FIG. 9 is a sectional view of the sheet feeder according to another modification of the first embodiment.

As Modification 2, FIG. 9 shows a configuration in which the fibrous members 164 are arranged at the outer peripheral surface of a roller portion 362 such that they make an obtuse angle with the outer peripheral surface of the roller portion 362 with respect to a predetermined rotation direction. When the sheet feed roller 110 rotates in a predetermined direction, the fibrous members 164 make an obtuse angle with respect to the rotative surface of the sheet feed roller 110. For this reason, the foreign substances 17 can be scraped off from the surface of the sheet feed roller. Therefore, the foreign substances 17 are effectively separated from the surface of the sheet feed roller 110 by the fibrous members 164.

Although Modification 1 and Modification 2 of the first embodiment have been described hitherto, the invention is not limited thereto. For example, some fibrous members 164 may be arranged so as to make an acute angle with the outer peripheral surface of the roller portion 262 with respect to a predetermined rotation direction and other fibrous members 164 may be arranged so as to make an obtuse angle with the outer peripheral surface of the roller portion 262 with respect to the predetermined rotation direction. According to this configuration, the effects shown in both Modification 1 and Modification 2 of the first embodiment can be obtained.

Next, referring to FIG. 10, the configuration of a sheet feeder in a second embodiment will be described in detail. The same parts as those of the first embodiment are denoted by the same reference numerals, and redundant detailed description thereof is omitted.

A roller member 461 includes a roller portion 462, and the fibrous members 164 arranged at the outer peripheral surface of the roller portion 462.

A protruding portion 469 is provided to protrude in the center of the roller portion 462 in the width direction of the sheet P (the right-and-left direction in FIG. 4). Here, the protruding portion 469 is formed at the outer peripheral surface of the roller portion 462 integrally with the roller portion 462. The fibrous members 164 are arranged at the outer peripheral surface of the roller portion 462. The fibrous members 164 are arranged such that they protrude in a radial direction of the roller portion 462 by a predetermined length from the protruding portion 469. Here, the radial direction means a direction that extends from the rotation center of the rotary shaft 163 to the outer peripheral surface of the roller portion 462. Therefore, the fibrous members 164 are caused to abut the rotation suppressing member 167 similarly to the first embodiment. Further, since the roller portion 462 is provided with the protruding portion 469, when there is no sheet P accommodated in the sheet feed tray 101, or when two or three sheets remain in the sheet feed tray 101, the fibrous members 164 are elastically deformed by the pressing force of the sheet feed roller 110, and thereby the sheet feed roller 110 abuts the protruding portion 469 directly or via the remaining sheets. Therefore, since the distance between the sheet feed roller 110 and the roller portion 462 are kept constant, the remaining sheet P can be stably conveyed by the sheet feed roller 110 and the roller member 161.

Further, the fibrous members 164 abut the rotation suppressing member 167. Thus, when the roller member 461 is rotated by the sheet feed roller 110, the fibrous members 164 are bent, and when the roller member is rotated further, the roller member is separated from the rotation suppressing member 167. At this time, the fibrous members 164 are going to return to their original shape by their elastic force, thereby separating the foreign substances 17 from the roller member 461. In this way, it is possible to prevent the foreign substances 17 from adhering again to the sheet feed roller 110 from the roller member 461.

Further, the fibrous members 164 may be arranged at the outer peripheral surface of the roller portion 462 such that they make an acute angle with the outer peripheral surface of the roller portion 462 with respect to a predetermined rotation direction. In this case, the same effects as those of Modification 1 of the first embodiment can be obtained.

Further, the fibrous members 164 may be arranged at the outer peripheral surface of the roller portion 462 such that they make an obtuse angle with the outer peripheral surface of the roller portion 462 with respect to a predetermined rotation direction. In this case, the same effects as those of Modification 2 of the first embodiment can be obtained.

Further, the fibrous members 164 may be configured such that some fibrous members 164 are arranged so as to make an acute angle with the outer peripheral surface of the roller portion 462 with respect to a predetermined rotation direction and other fibrous members 164 are arranged so as to make an obtuse angle with the outer peripheral surface of the roller portion 462 respect to the predetermined rotation direction. In this case, the effects shown in both Modification 1 and Modification 2 of the first embodiment can be obtained.

Further, although the case where the protruding portion 469 is formed at the outer peripheral surface of the roller portion 462 integrally with the roller portion 462 has been described in the present embodiment, it may be possible to adopt a configuration in which the protruding portion 469 is formed as a member separate from the roller portion 462. In such a configuration, the protruding portion 469 is subsequently secured to the outer peripheral surface of the roller portion 462.

Figure 11B:
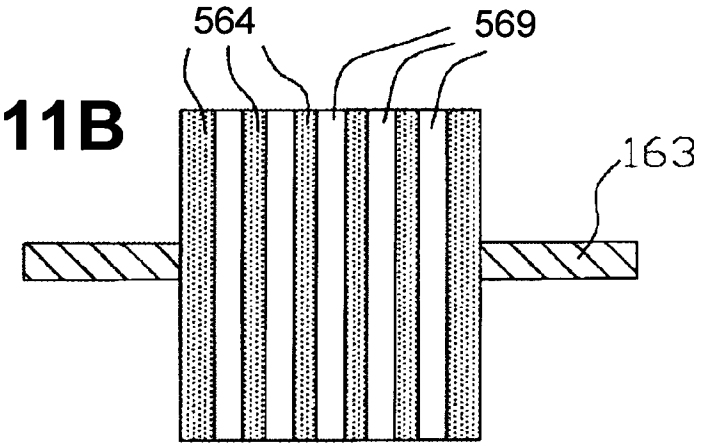
FIGS. 11A, 11B, and 11C are schematic views illustrating a roller member according to modifications of the second embodiment.
Figure 11C:
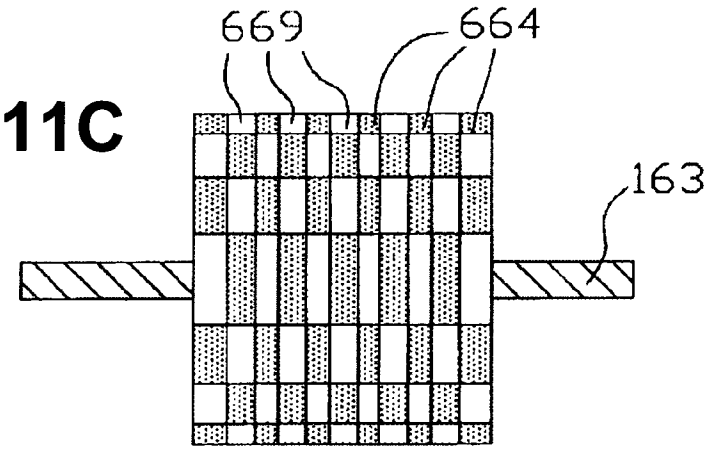
Figure 11A:
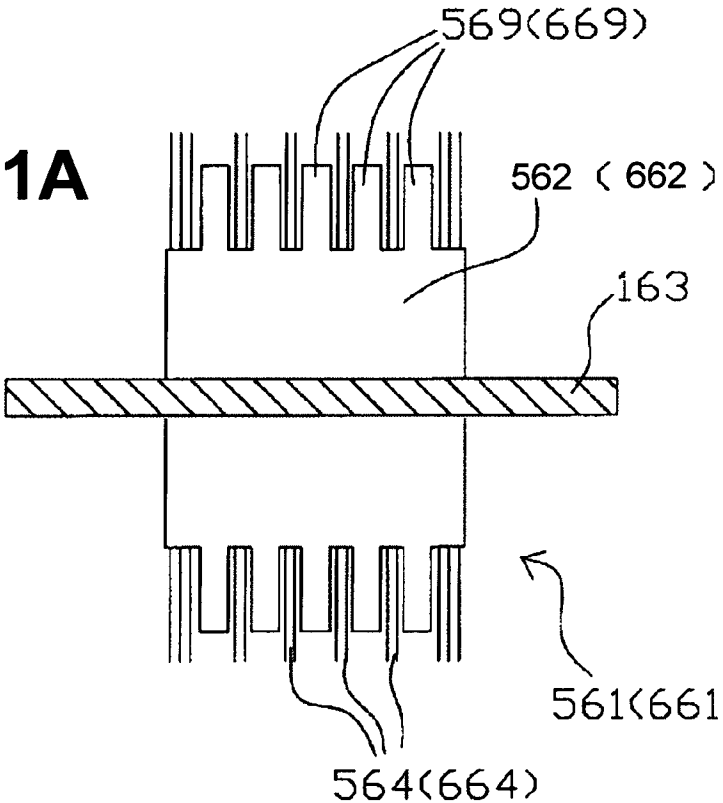

As Modification 1 of a second embodiment, FIGS. 11A and 11B show a configuration in which a plurality of protruding portions 569 are provided in a roller portion 562 in the width direction of the sheet P. A plurality of protruding portions 569 are provided in the roller portion 562 in the width direction of the sheet P (the right-and-left direction in FIG. 11A). The fibrous members 564 are arranged at the outer peripheral surface of the roller portion 562. The fibrous members 564 are arranged such that they protrude in a radial direction of the roller portion 562 by a predetermined length from the protruding portions 569. According to this configuration, similarly to the second embodiment, when there is no sheet P accommodated in the sheet feed tray 101 or when two or three sheets remain in the sheet feed tray, the protruding portions 569 abut the sheet feed roller 110 directly or via the remaining sheets. Thus, the positional relationship between the sheet feed roller 110 and the roller portion 562 can be kept constant. Therefore, the remaining sheet P can be stably conveyed by the sheet feed roller 110 and a roller member 561. Further, since the plurality of the protruding portions 569 are provided, the fibrous members 164 are dispersedly arranged at the outer peripheral surface of the roller portion 562. Therefore, the foreign substances 17 can be separated from the surface of the sheet feed roller 110 over a wide range. Further, when the roller member 561 is rotated by the sheet feed roller 110, the fibrous members 564 abut, and are bent by, the rotation suppressing member 167. When the roller member is rotated further, the roller member is separated from the rotation suppressing member 167. At this time, the fibrous members 564 return to their original shape via their elastic force, thereby separating the foreign substances 17 from the roller member 561. In this way it is possible to prevent the foreign substances 17 from adhering again to the sheet feed roller 110 from the roller member 561.

Further, as shown in FIGS. 11A and 11C, a configuration may be adopted in which protruding portions 669 and the fibrous members 164 are arranged in a checkered pattern at the outer peripheral surface of a roller portion 662.

Figure 12B:
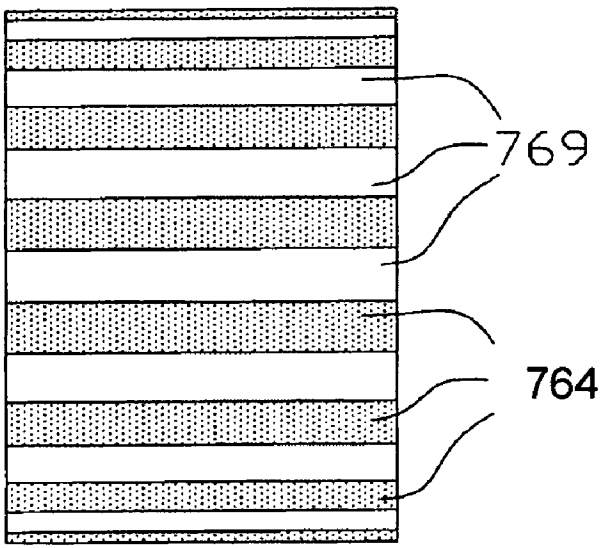
FIGS. 12A and 12B are schematic views illustrating a roller member according to another modification of the second embodiment.
Figure 12A:
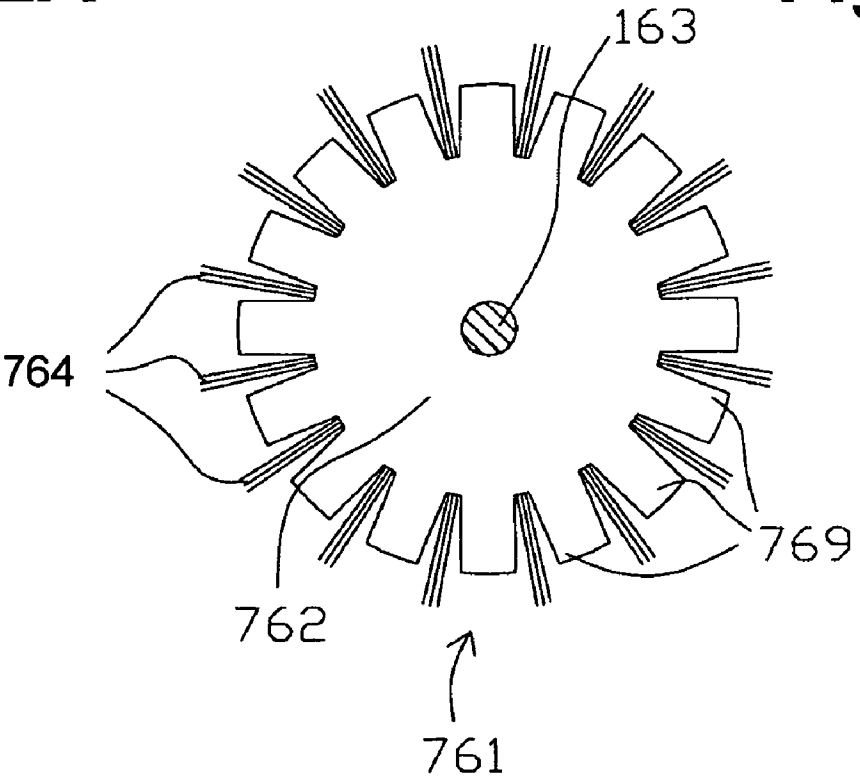

Although Modification 1 of the second embodiment has been shown hitherto, the invention is not limited thereto. For example, as shown in FIGS. 12A and 12B, a plurality of protruding portions 769 may be provided in a roller portion 762 in the longitudinal direction of the sheet P. Since a wide range of the surface of the sheet feed roller 110 and the fibrous members 764 abut each other, it is possible to separate the foreign substances 17 from the surface of the sheet feed roller 110 over a wide range.

Further, the fibrous members 564, 664, 764 may be arranged at the outer peripheral surface of the roller portion 562, 662, 762 respectively such that they make an acute angle or an obtuse angle with the outer peripheral surface of the roller portion 562, 662, 762 respectively with respect to the a predetermined rotation direction. According to this configuration, the effects shown in the modifications of the first embodiment and the modifications of the second embodiments can be obtained.

Alternatively, a configuration in which some fibrous members 564, 664, 764 are arranged so as to make an acute angle with the outer peripheral surface of the roller portion 562, 662, 762 respectively with respect to a predetermined rotation direction and other fibrous members 564, 664, 764 are arranged so as to make an obtuse angle with the outer peripheral surface of the roller portion 562, 662, 762 respectively with respect to the predetermined rotation direction may also be provided at the outer peripheral surface of the roller portion 562, 662, 762. According to this configuration, the effects shown in both the modifications of the first embodiment and the modifications of the second embodiment can be obtained.

Next, referring to FIG. 13, the configuration of a sheet feeder in a third embodiment will be described in detail. The same parts as those of the first embodiment are denoted by the same reference numerals, and redundant detailed description thereof is omitted.

Figure 13:
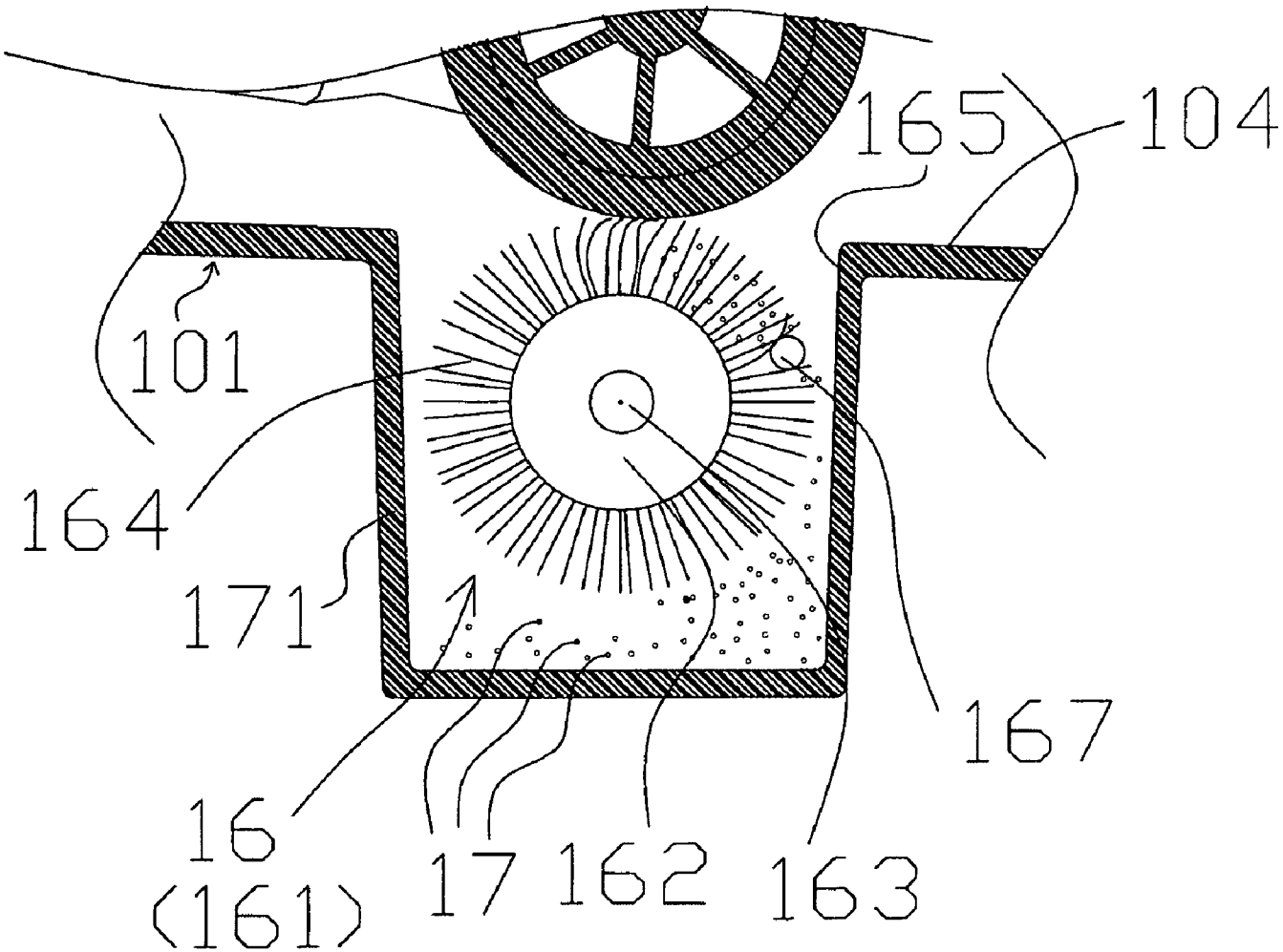
FIG. 13 is a sectional view of principal parts of a sheet feeder according to a third embodiment (taken along the line XIII-XIII in FIG. 4).

Referring to FIG. 13, when the sheets P are placed on the front face of the bottom plate 104, a foreign substance storage portion 171 protrudes from the rear face of the bottom plate 104, and is formed integrally with the sheet feed tray 101. The foreign substance storage portion 171 is a substantially rectangular parallelepiped box that is open in common with the hole 165.

The foreign substances 17 separated from the sheet feed roller 110 are stored in the foreign substance storage portion 171. Accordingly, since the foreign substances 17 can be collected, scattering of foreign substances 17 can be prevented.

Figure 14:
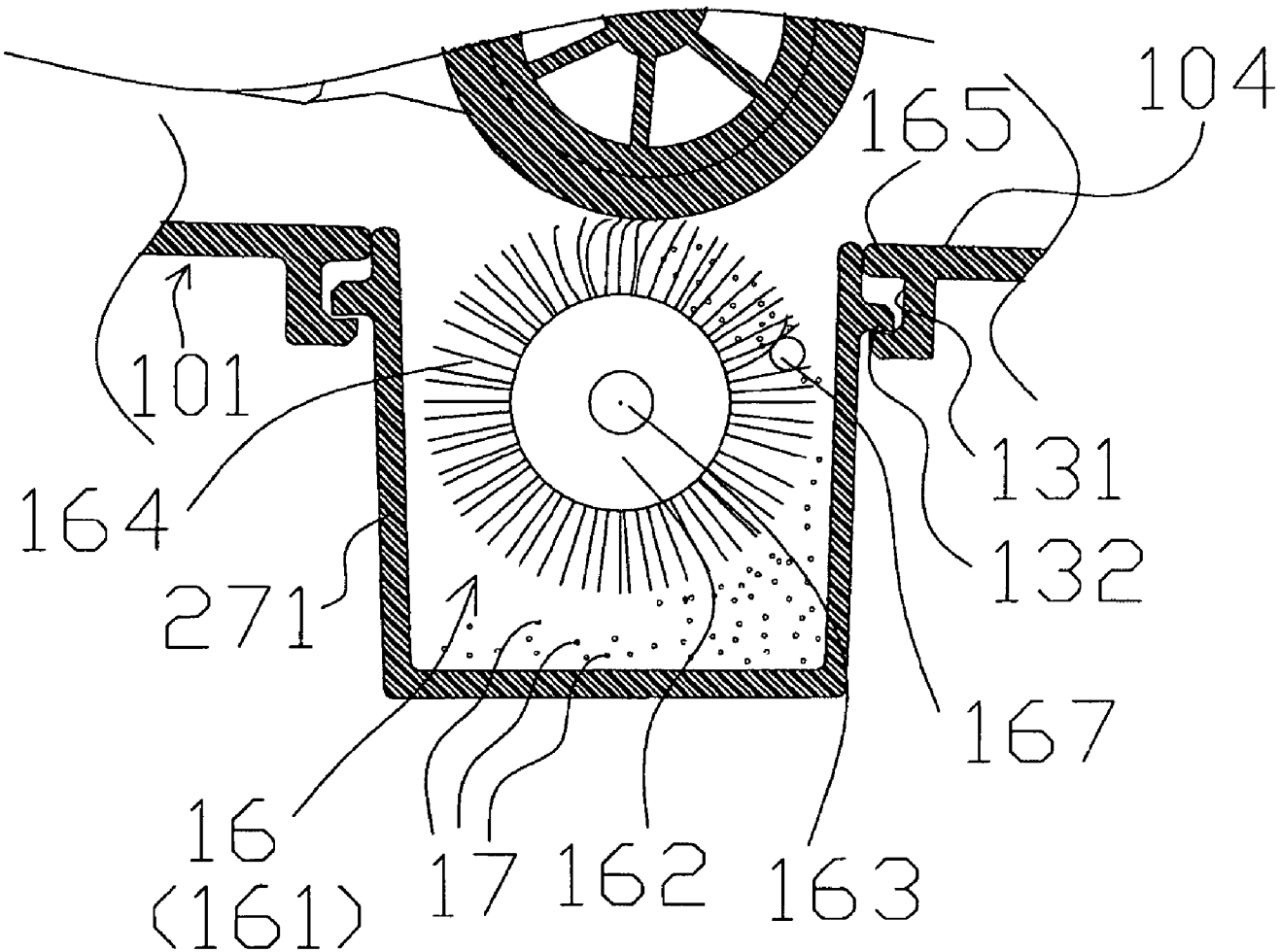
FIG. 14 is a sectional view of principal parts of a sheet feeder according to a modification of the third embodiment.

Further, as a modification of the third embodiment, as shown in FIG. 14, a foreign substance storage portion 271 may be detachably attached to the rear face of the bottom plate 104 near the hole 165. Recesses 131 are provided in the rear face of the bottom plate 104 near the hole 165. The recesses 131 are provided integrally with the bottom plate 104. Projections 132 are respectively provided in two opposite walls of the foreign substance storage portion 271. The recesses 131 and the projections 132 are disposed in the positions where they fit to each other. By detachably providing the foreign substance storage portion 271 in this way, a user can detach the foreign substance storage portion 271 and dump the foreign substances 17 when the foreign substances 17 accumulate in the foreign substance storage portion 271. Therefore, when the foreign substances 17 are accumulated in the foreign substance storage portion, the foreign substances 17 can be dumped easily.

Figure 15:
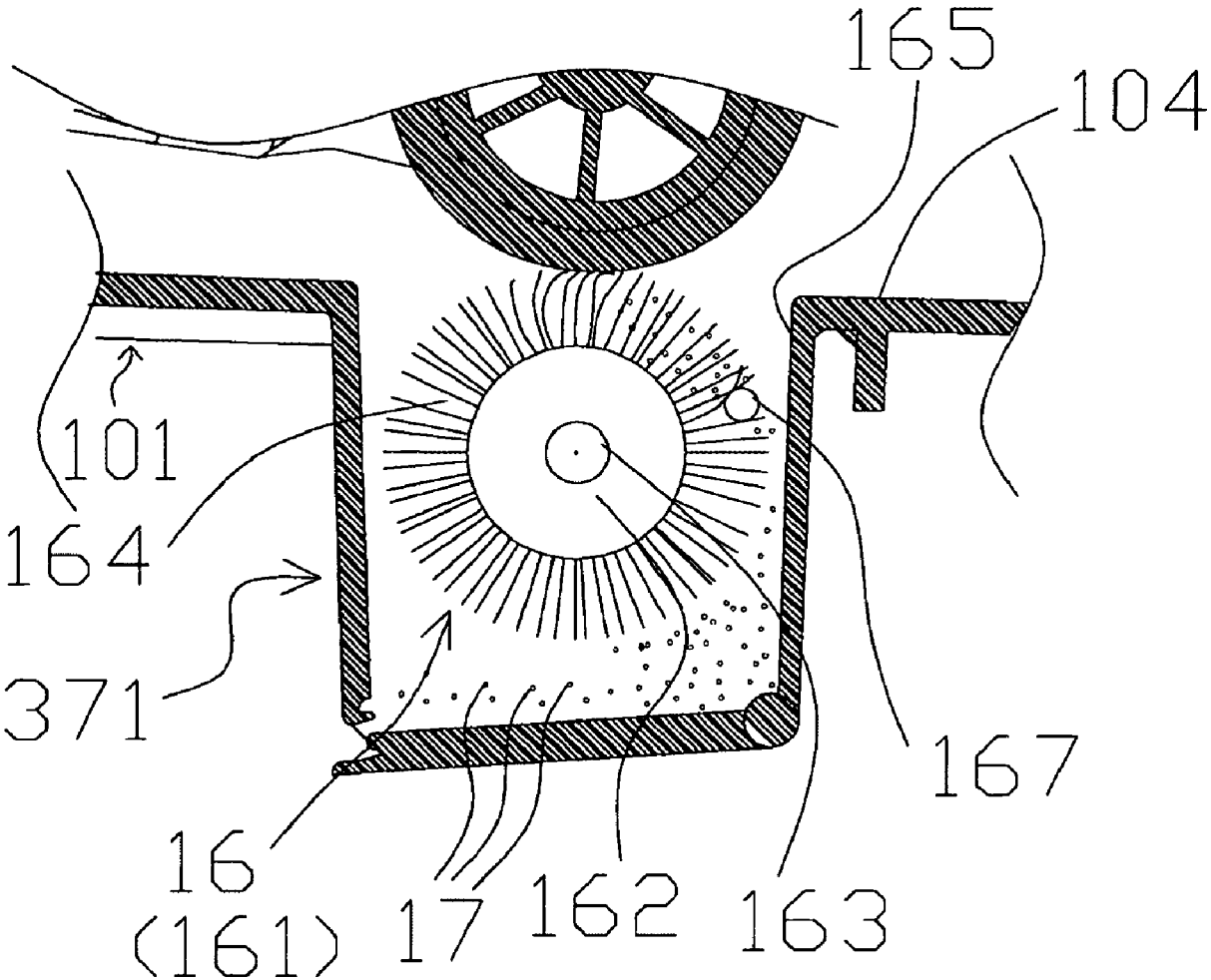
FIG. 15 is a sectional view of a sheet feeder according to another modification of the third embodiment.

Further, as another modification, as shown in FIG. 15, the bottom face of a foreign substance storage portion 371 may be configured in an openable or closable manner. Accordingly, when the foreign substances 17 are accumulated in the foreign substance storage portion 371, a user can open a portion of the foreign substance storage portion 371 to dump the foreign substances 17. Therefore, the same effects can be obtained as those in the case where the foreign substance storage portion 171 is provided detachably.

In sheet feeder according to another embodiment of the current invention, the friction member is a rotatable roller member, and when there is no sheet in the sheet storing unit, the sheet feed roller abuts the roller member. Therefore, even when there is no sheet on a sheet placing surface of the sheet storing unit, it is possible to prevent an excessive load from being applied to the sheet feed roller. Further, a rotation suppressing member that suppresses the rotation of the roller member is provided. Accordingly, even when a few sheets are left in the sheet storing unit, double feeding can be prevented because a frictional force between the roller member and the lowermost sheet is sufficiently obtained. Moreover, a number of fibrous members are arranged at the outer peripheral surface of the roller portion. When there is no sheet in the sheet storing unit, the sheet feed roller abuts the roller member. By the rotation of the sheet feed roller in this state, foreign substances, such as paper debris adhering to the surface of the sheet feed roller, can be separated from the surface of the sheet feed roller, so that the frictional force of the sheet feed roller surface can be restored.

In a sheet feeder according to yet another embodiment of the current invention, the rotation suppressing member is disposed in a position abutting the fibrous members. Accordingly, the fibrous members arranged at the outer peripheral surface of the roller member are bent by the rotation suppressing member when the roller member is rotated. As the roller member is rotated further, the fibrous members are released from the rotation suppressing member. The impact upon this release makes it possible to the separate foreign substances which have been removed from the surface of the sheet feed roller by the fibrous members, from the roller member This makes it possible to prevent the foreign substances from adhering again to the sheet feed roller. Further, the rotation suppressing member is disposed on the downstream side of the rotary shaft of the roller member in the predetermined sheet conveying direction. Accordingly, when foreign substances are separated from the roller member, the foreign substances are separated downward by the rotation suppressing member. Further, since a downward force is applied to the foreign substances so as to shake off the foreign substances, the foreign substances are kept away from the sheet feed roller and the sheets.

In another embodiment of the present invention, the fibrous members are arranged at the outer peripheral surface of the roller portion such that the fibrous members make an acute angle with the outer peripheral surface of the roller portion with respect to a rotation direction of the roller portion when the sheets are conveyed in the predetermined conveying direction. Therefore, the bending amount of the fibrous members can be increased when the fibrous members are bent by the rotation of the roller member. For this reason, the impact when the fibrous members are separated from the rotation suppressing means increases. As a result, the foreign substances which have been removed from the surface of the sheet feed roller by the fibrous members, can be more reliably separated from the roller member. In this way, the foreign substances can be prevented from adhering again to the sheet feed roller.

In yet another embodiment of the present invention, the fibrous members are arranged at the outer peripheral surface of the roller portion such that the fibrous members make an obtuse angle with the outer peripheral surface of the roller portion with respect to the rotation direction of the roller portion. That is, when the fibrous members abut the surface of the sheet feed roller, the fibrous members make an obtuse angle with respect to the rotation direction of the sheet feed roller when the sheets are conveyed in the predetermined conveying direction. For this reason, foreign objects can be scraped off from the surface of the sheet feed roller. Therefore, foreign objects adhering to the surface of the sheet feed roller can be separated effectively.

In sheet feeder according to another embodiment of the current invention, the fibrous members and a protrusion are arranged at the outer peripheral surface of the roller portion. According to this configuration, when there is no sheet in the sheet storing unit, the sheet feed roller abuts the fibrous members and the protrusion of the roller portion. When there is no sheet in the sheet storing unit, or when a few sheets remain in the sheet storing unit, the protrusion abuts the sheet feed roller directly of indirectly. Thus, the positional relationship between the sheet feed roller and the roller portion can be kept constant. Accordingly, the remaining sheets P can be conveyed stably by the sheet feed roller and the roller portion.

In a sheet feeder according to yet another embodiment of the current invention, a foreign substance storing member for storing foreign substances separated from the sheet feed roller is provided below the opening for the roller portion. Thereby, the foreign substances, which have been separated from the surface of the sheet feed roller by the fibrous members, can be collected, and scattering of the foreign substances can be prevented.

In another embodiment of the present invention, the foreign substance storing member is provided detachably. Further, according to yet another embodiment of the present invention, a portion of the foreign substance storing member is configured to be opened and closed. Therefore, when the foreign substances are accumulated in the foreign substance storage portion, the foreign substances can be dumped easily.

According to another embodiment of the current invention, a sheet feeder as described above is applied to an image forming device. Thus, the sheets can be conveyed stably, and troubles during formation of an image can be reduced. Therefore, the quality of the image formed can be improved.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. A sheet feeder comprising:

a sheet storing unit having a bottom plate on which a plurality of sheets are stacked;

a sheet feed roller that is configured to abut an uppermost one of the sheets stacked on the bottom plate and convey the sheets in a predetermined conveying direction;

a friction member that is provided in a position of the bottom plate that faces the sheet feed roller, and is configured to abut a lowermost one of the sheets stacked in the sheet storing unit; and a rotation suppressing member configured to suppress rotation of the friction member;

wherein the friction member is a roller member comprising:

a roller portion; and a plurality of fibrous members arranged at an outer peripheral surface of the roller portion;

wherein the bottom plate of the sheet storing unit is provided with an opening that houses the friction member;

wherein the sheet feed roller abuts the friction member when there is no sheet in the sheet storing unit; and wherein the rotation suppressing member is provided in a position abutting the fibrous members.

2. The sheet feeder according to claim 1;

wherein the rotation suppressing member is provided on a downstream side of the roller portion of the friction member in the predetermined conveying direction.

3. The sheet feeder according to claim 1;

wherein the fibrous members are arranged such that the fibrous members make an acute angle with the outer peripheral surface of the roller portion with respect to a direction in which the friction member rotates while abutting the sheet feed roller.

4. The sheet feeder according to claim 1;

wherein the fibrous members are arranged such that the fibrous members make an obtuse angle with the outer peripheral surface of the roller portion with respect to a direction in which the friction member rotates while abutting the sheet feed roller.

5. The sheet feeder according to claim 1;

wherein a protrusion protrudes radially from an outer peripheral surface of the roller portion of the friction member; and wherein the fibrous members are arranged at a portion of the outer peripheral surface of the roller portion other than the protrusion.

6. The sheet feeder according to claim 1, further comprising:

a foreign substance storage portion that stores foreign substances separated from the sheet feed roller;

wherein the foreign substance storage portion is disposed below the opening that houses the friction member.

7. The sheet feeder according to claim 6;

wherein the foreign substance storing member is provided detachably.

8. The sheet feeder according to claim 6;

wherein a portion of the foreign substance storing member is configured to be opened and closed.

9. An image forming device comprising:

a printer unit that forms a desired image on a sheet; and a sheet feeder comprising:

a sheet storing unit having a bottom plate on which a plurality of sheets are stacked;

a sheet feed roller that is configured to abut an uppermost one of the sheets stacked on the bottom plate and convey the sheets in a predetermined conveying direction;

a friction member that is provided in a position of the bottom plate that faces the sheet feed roller, and is configured to abut a lowermost one of the sheets stacked in the sheet storing unit; and a rotation suppressing member configured to suppress rotation of the friction member;

wherein the friction member is a roller member comprising:

a roller portion; and a plurality of fibrous members arranged at an outer peripheral surface of the roller portion;

wherein the bottom plate of the sheet storing unit is provided with an opening that houses the friction member;

wherein the sheet feed roller abuts the friction member when there is no sheet in the sheet storing unit; and wherein the rotation suppressing member is provided in a position abutting the fibrous members.

10. A sheet feeder comprising:

a sheet storing unit in which a plurality of sheets are stacked;

a sheet feed roller configured to abut an uppermost one of the sheets stacked in the sheet storing unit;

a friction member configured to abut a lowermost one of the sheets stacked in the sheet storing unit, the friction member including a plurality of fibrous members; and a rotation suppressing member configured to suppress rotation of the friction member;

wherein the sheet feed roller abuts the friction member when there is no sheet in the sheet storing unit; and wherein the rotation suppressing member is provided in a position abutting the fibrous members.

11. The sheet feeder of claim 10;

wherein the friction member includes:

a roller portion;

wherein the plurality of fibrous members are arranged at an outer peripheral surface of the roller portion; and wherein the rotation suppressing member is provided in a position that is radially outside the outer peripheral surface of the roller portion.

12. The sheet feeder according to claim 11;

wherein there is a predetermined conveying direction for conveying the sheets; and wherein the rotation suppressing member is provided on a downstream side of the roller portion in the predetermined conveying direction.

13. The sheet feeder according to claim 11;

wherein a protrusion protrudes from an outer peripheral surface of the roller portion; and wherein the fibrous members are arranged at a portion of the outer peripheral surface of the roller portion other than the protrusion.

14. The sheet feeder according to claim 11, further comprising:

a foreign substance storage portion that stores foreign substances separated from the sheet feed roller;

wherein the foreign substance storage portion is disposed below the friction member.

15. The sheet feeder according to claim 1;

wherein the rotation suppressing member is provided in a position that is radially outside the outer peripheral surface of the roller portion.

16. The sheet feeder according to claim 9;

wherein the rotation suppressing member is provided in a position that is radially outside the outer peripheral surface of the roller portion.

* * * * *

UNITED STATES PATENT AND TRADEMARK OFFICE

CERTIFICATE OF CORRECTION

PATENT NO. : 7,547,012 B2
APPLICATION NO. : 11/715002
DATED : June 16, 2009
INVENTOR(S) : Masatoshi Izuchi It is certified that error appears in the above-identified patent and that said Letters Patent is hereby corrected as shown below:

Title Page; Please correct the title so as to include the word "and", as per below:

"(54) SHEET FEEDER AND IMAGE FORMING DEVICE"

Signed and Sealed this

Twenty-ninth Day of September, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,547,012 B2
APPLICATION NO. : 11/715002
DATED : June 16, 2009
INVENTOR(S) : Masatoshi Izuchi It is certified that error appears in the above-identified patent and that said Letters Patent is hereby corrected as shown below:

Title Page, Item (54) and Column 1, line 1; Please correct the title so as to include the word "and", as per below:

"SHEET FEEDER AND IMAGE FORMING DEVICE"

This certificate supersedes the Certificate of Correction issued September 29, 2009.

Signed and Sealed this

Twenty-seventh Day of October, 2009

David J. Kappos

David J. Kappos
*Director of the United States Patent and Trademark Office*